US009738073B2

(12) United States Patent
Dai et al.

(10) Patent No.: US 9,738,073 B2
(45) Date of Patent: Aug. 22, 2017

(54) PRINTING HEAD AND INK-JET PRINTING DEVICE

(71) Applicant: BOE TECHNOLOGY GROUP CO., LTD., Beijing (CN)

(72) Inventors: Qing Dai, Beijing (CN); Chunjing Hu, Beijing (CN); Ying Cui, Beijing (CN); Ze Liu, Beijing (CN); Shoulei Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/913,724

(22) PCT Filed: Aug. 19, 2015

(86) PCT No.: PCT/CN2015/087515
§ 371 (c)(1),
(2) Date: Feb. 23, 2016

(87) PCT Pub. No.: WO2016/169167
PCT Pub. Date: Oct. 27, 2016

(65) Prior Publication Data

US 2017/0057226 A1 Mar. 2, 2017

(30) Foreign Application Priority Data

Apr. 21, 2015 (CN) ..... 2015 1 0189023

(51) Int. Cl.
*B41J 2/14* (2006.01)

(52) U.S. Cl.
CPC ..... *B41J 2/1433* (2013.01); *B41J 2/14233* (2013.01)

(58) Field of Classification Search
CPC ..... B41J 2/1433; B41J 2002/14475; B41J 2/14274; B41J 2202/20; B41J 2/135;
(Continued)

(56) References Cited

U.S. PATENT DOCUMENTS 5,243,755 A 9/1993 Inaba et al.
6,092,887 A 7/2000 Tanino et al.
(Continued)

FOREIGN PATENT DOCUMENTS

CN 1162288 A 10/1997
CN 102114731 A 7/2011
(Continued)

OTHER PUBLICATIONS

1st Office Action issued in Chinese application No. 201510189023.6 dated Dec. 17, 2015.
(Continued)

*Primary Examiner* — Lamson Nguyen
(74) *Attorney, Agent, or Firm* — Nath, Goldberg & Meyer; Joshua B. Goldberg; Christopher Thomas

(57) ABSTRACT

The present invention provides a printing head comprising a plurality of sub-heads each comprising a base and a plurality of diversion trenches provided in the base, and one end of each of the diversion trenches is connected to one of nozzles of the sub-head. Projections of all the diversion trenches on a first plane in a first projection direction are arranged at an equal interval, the first plane is a plane defined by an arrangement direction and a length direction of the diversion trenches in the sub-head, and the first projection direction is a moving direction of the printing head with respect to a printing surface during printing. The spacing of the diversion trenches in each of the sub-heads is greater than that of the projections of all the diversion trenches in the first plane on the first projection direction.

18 Claims, 11 Drawing Sheets

(58) Field of Classification Search
CPC ..... B41J 2/16; B41J 2/1612; B41J 2202/15; B51J 2/14233
See application file for complete search history.

(56) References Cited

U.S. PATENT DOCUMENTS

| | | | |
|---|---|---|---|
| 6,281,914 | B1 | 8/2001 | Hiwada et al. |
| 2002/0071009 | A1 | 6/2002 | Yamada et al. |
| 2004/0130602 | A1 | 7/2004 | Watanabe |
| 2004/0141032 | A1 | 7/2004 | Matsuzawa et al. |
| 2005/0206678 | A1 | 9/2005 | Nishino |

FOREIGN PATENT DOCUMENTS

| | | | |
|---|---|---|---|
| CN | 102821965 | A | 12/2012 |
| CN | 103009811 | A | 4/2013 |
| CN | 104742524 | A | 7/2015 |
| EP | 0 713 775 | A2 | 5/1996 |
| TW | 201124285 | A | 7/2011 |
| WO | 91/17051 | A1 | 11/1991 |

OTHER PUBLICATIONS

ISR issued in International application No. PCT/CN2015/087515 dated Jan. 7, 2016.

PRINTING HEAD AND INK-JET PRINTING DEVICE

CROSS REFERENCE

This is a National Phase Application filed under 35 U.S.C. 371 as a national stage of PCT/CN2015/087515 filed on Aug. 19, 2015, an application claiming the benefit of Chinese Application No. 201510189023.6 filed on Apr. 21, 2015, the content of each of which is hereby incorporated by reference in its entirety.

FIELD OF THE INVENTION

The present invention relates to the field of printing devices, and in particular to a printing head and an ink-jet printing device.

BACKGROUND OF THE INVENTION

Ink-jet printing devices have been wildly used due to their advantages of low cost, friendly manufacturing environment, simple operation and the like. A printing head is an important component of an ink-jet printing device.

FIG. 1A and FIG. 1B show a printing head according to the prior art. As shown in FIG. 1, the printing head includes a base 10, and a common ink tank 11 and a plurality of diversion trenches (for example, diversion trenches 12 to 16) provided on the base 10. The plurality of diversion trenches are arranged on the base 10 at an equal interval. One end of each of the diversion trenches is connected to the common ink tank 11 and the other end thereof is respectively connected to a corresponding nozzle (for example, one of nozzles 12*a* to 16*a*). A protection film 18 and piezoelectric material 19 cover openings of all the diversion trenches.

As the piezoelectric material 19 has an inverse piezoelectric effect, the piezoelectric material 19 will be deformed after a voltage is applied thereto, thereby changing the volume of a corresponding diversion trench to complete a cyclic process of ink absorption, ink jet, retraction and ink re-absorption. Ink can be sucked from the common ink tank 11 and then jetted from a corresponding nozzle to complete the printing by controlling the deformation of the piezoelectric material 19.

Inventors have found that the printing head according to the prior art has the following defect at least: the distance between adjacent diversion trenches on the base 10 is small when there are many nozzles arranged in the printing head. When a nozzle jets ink due to the deformation of the piezoelectric material 19, the deformation of the part of the piezoelectric material 19 corresponding to the nozzle will influence the shape of the piezoelectric material 19 above the diversion trenches adjacent to the diversion trench corresponding to the nozzle (as shown in FIG. 1B, the deformation of the part of the piezoelectric material 19 above the diversion trench 13 influences the shape of the piezoelectric material 19 above the diversion trenches 12 and 14), thereby resulting in interference between the adjacent nozzles. With the increase of the density of the nozzles, such interference will be more and more serious. As a result, the quality of printing will be influenced.

SUMMARY OF THE INVENTION

In the prior art, there are two methods for reducing the interference. The first one is: changing the structure of the ink intake channel of the nozzle portion such that two adjacent spacers for separating adjacent nozzles are arranged to have different lengths, that is, the portion of the diversion trench close to the nozzle is different from that connected to the common trench so that the interference between the adjacent nozzles is reduced; and the second one is: optimizing a circuit signal to eliminate or reduce the generation of the interference, that is, at the same time of jetting ink from one nozzle, a corresponding reverse compensation drive signal is applied to nozzles adjacent to the nozzle, to offset the interference to the adjacent nozzles.

Inventors of the present invention propose a method different from the aforementioned methods for reducing the interference.

In order to solve the aforementioned technical problem in the prior art, the present invention provides a printing head and an ink-jet printing device.

According to one aspect of the present invention, a printing head is provided, which includes a plurality of sub-heads each including a base and a plurality of diversion trenches provided in the base, and one end of each of the diversion trenches is connected to one of nozzles of the sub-head. Projections of all the diversion trenches on a first plane in a first projection direction are arranged at an equal interval, the first plane is a plane defined by an arrangement direction and a length direction of the diversion trenches in the sub-head, and the first projection direction is a moving direction of the printing head with respect to a printing surface during printing. A spacing of the diversion trenches on each of the sub-heads is greater than that of projections of all the diversion trenches on the first plane in the first projection direction.

According to the embodiments of the present invention, the diversion trenches corresponding to any two adjacent projections on the first plane may belong to different sub-heads.

According to the embodiments of the present invention, each of the sub-heads may further include an ink tank arranged on the base and communicated with each of the diversion trenches.

According to the embodiments of the present invention, the printing head may further include a common ink inlet and a common ink outlet. One end of the ink tank of each of the sub-heads is connected to the common ink inlet and the other end thereof is connected to the common ink outlet.

According to the embodiments of the present invention, the arrangement directions of all the diversion trenches may be parallel to each other.

According to the embodiments of the present invention, projections of starting nozzles of the respective sub-heads on a second plane in the first projection direction are arranged at an equal interval, the starting nozzle is the first one of the nozzles of each of the sub-heads in a same direction, and the second plane is a plane defined by an arrangement direction and a liquid outlet direction of the nozzles of the sub-head.

According to the embodiments of the present invention, each of the sub-heads may further include a sliding mechanism for adjusting relative positions of the plurality of sub-heads in the arrangement direction of the diversion trenches.

According to the embodiments of the present invention, the printing head may further include an angle adjusting mechanism for adjusting an included angle between the arrangement direction of the diversion trenches of the sub-head and the first projection direction to meet the following formula: $\cos(k-90)=f/e$, where k is an included angle, greater than or equal to 90°, between a second plane and the first projection direction, the second plane is a plane defined by an arrangement direction and a liquid outlet direction of the nozzles of the sub-head, e is a spacing of projections of all the nozzles on the second plane in the first projection direction, and f is a pixel pitch.

According to the embodiments of the present invention, a distance between top surfaces of any two adjacent sub-heads is the same.

According to the embodiments of the present invention, each of the sub-heads has the same number of nozzles.

According to another aspect of the present invention, an ink-jet printing device is provided, which includes the printing head according to the present invention.

The nozzles are arranged on a plurality of sub-heads, so that, in the case of a same pixel pitch, the number of the nozzles in each of the sub-heads is relatively small, and the spacing of the diversion trenches corresponding to the respective nozzles is thus relatively large. As a result, the interference among the nozzles caused by the same piezoelectric material is reduced, and the quality of printing is thus improved.

BRIEF DESCRIPTION OF THE DRAWINGS

It should be understood that, the aforementioned general description and detailed description hereinafter are merely exemplary and explanatory, and the present invention is not limited thereto. The accompanying drawings of the present invention are incorporated into the specification and constitute a part of the specification. The accompanying drawings show the embodiments of the present invention and are used for explaining the principle of the present invention together with the specification.

Embodiments of the present invention are shown in the accompanying drawings, and will be further described in detail below with reference to the accompanying drawings. However, these accompanying drawings and description are intended to make the disclosure thorough and complete and to completely convey the concept of the present invention to those skilled in the art, instead of limiting the scope of the concept of the present invention in any form.

DESCRIPTION OF THE PREFERRED EMBODIMENT

The exemplary embodiments shown in the accompanying drawings will be described in detail herein. In the accompanying drawings, dimensions and relative dimensions of each layer and each region will be exaggerated for the purpose of clarity. The same reference numbers always designate the same elements. Implementations to be described in the following exemplary embodiments do not represent all the implementations consistent with the present invention. Instead, they are only examples of devices or methods consistent with some aspects of the present invention as described in detail in the attached claims.

The printing head may mainly include a piezoelectric head and a bubble head. The embodiments of the present invention will be described by taking a piezoelectric head as an example. However, those skilled in the art can readily apply the concept of the present invention to a bubble head upon reading the specification of the present invention.

Figure 1A:
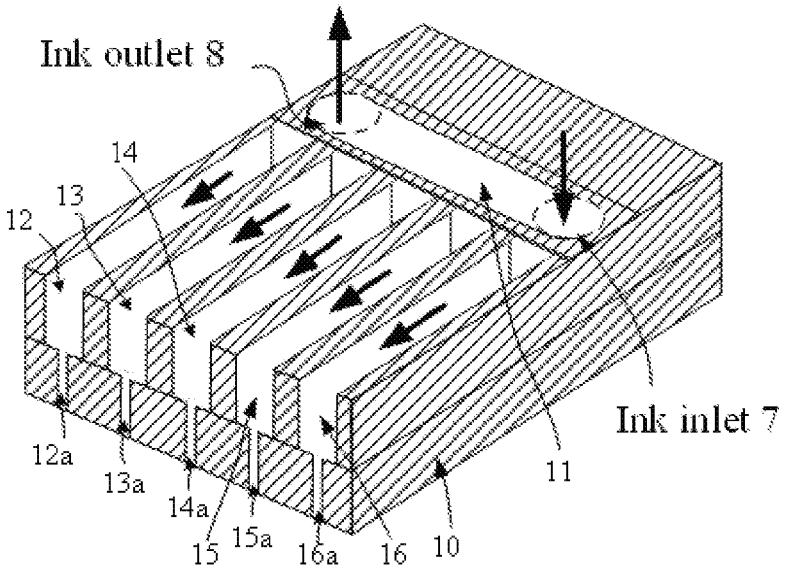
Fig. 1A (PRIOR ART)
FIG. 1A and FIG. 1B are schematic structure diagrams of a printing head in the prior art.
Figure 1B:
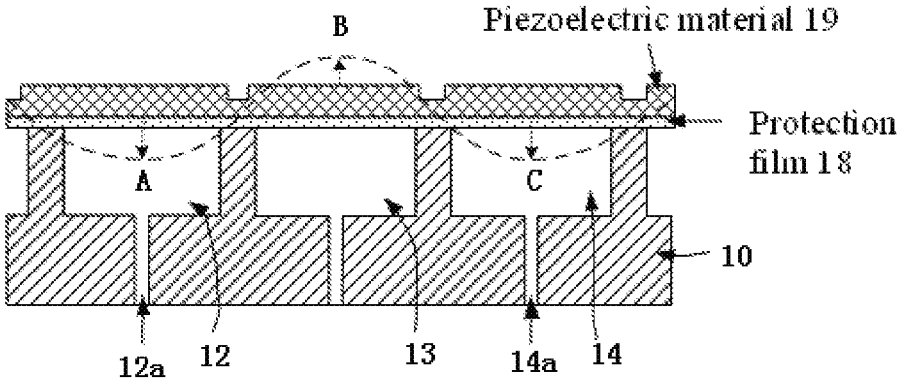
Fig. 1B (PRIOR ART)
Figure 2:
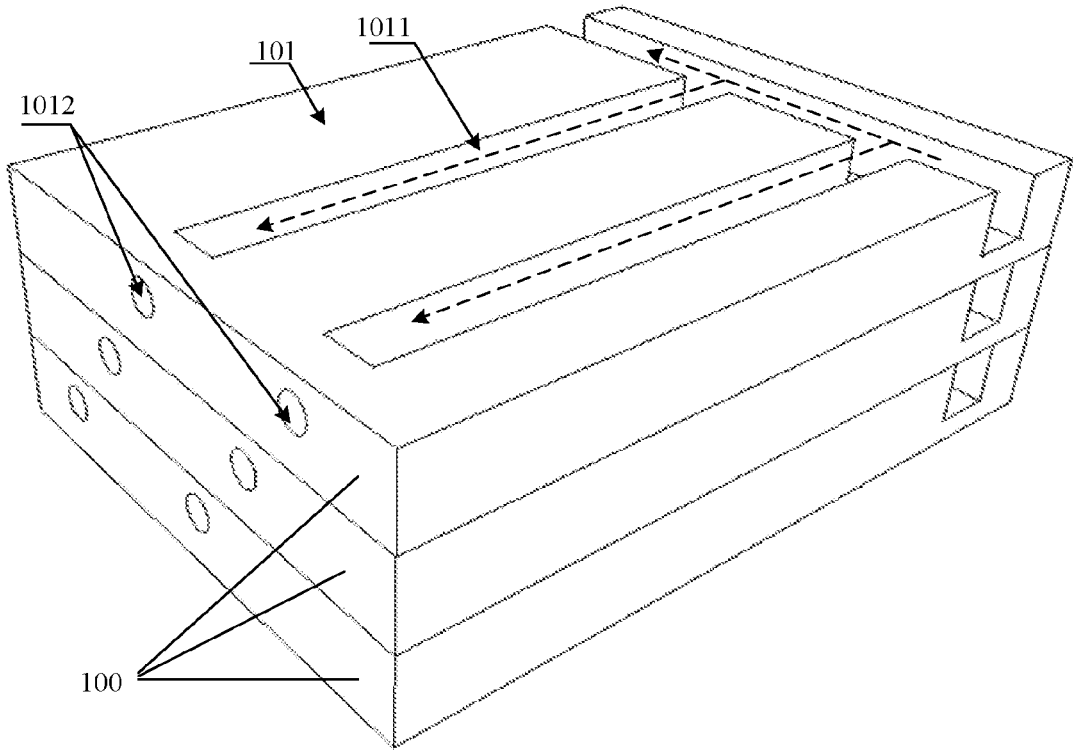
FIG. 2 is a schematic structure diagram of a printing head according to an exemplary embodiment of the present invention.
Figure 3:
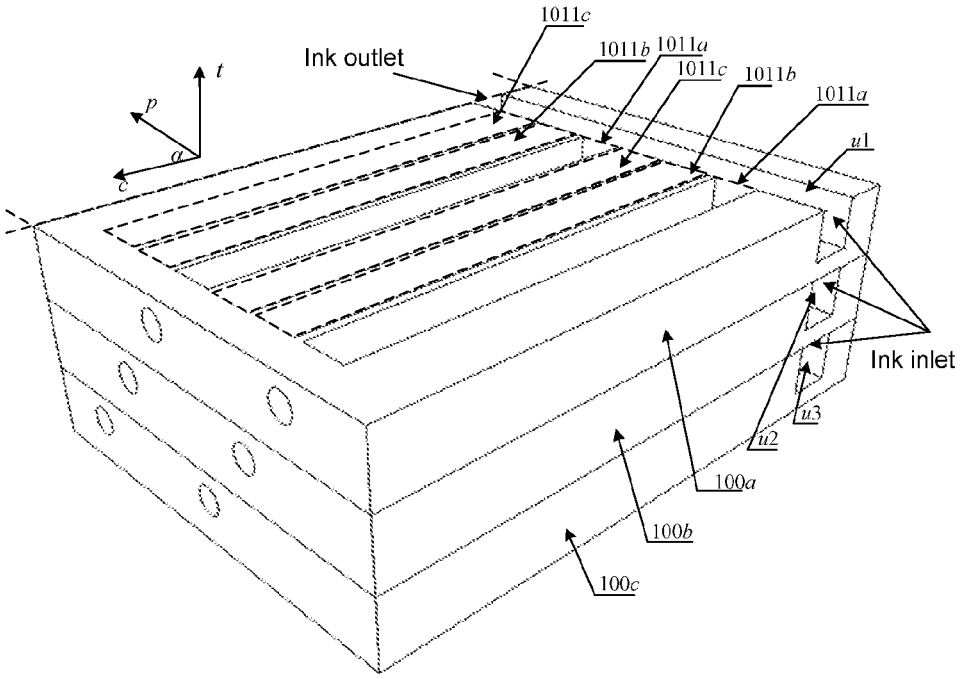
FIG. 3 is a schematic diagram of projections, in a diversion trench plane, of diversion trenches of the printing head as shown in FIG. 2.
Figure 4:
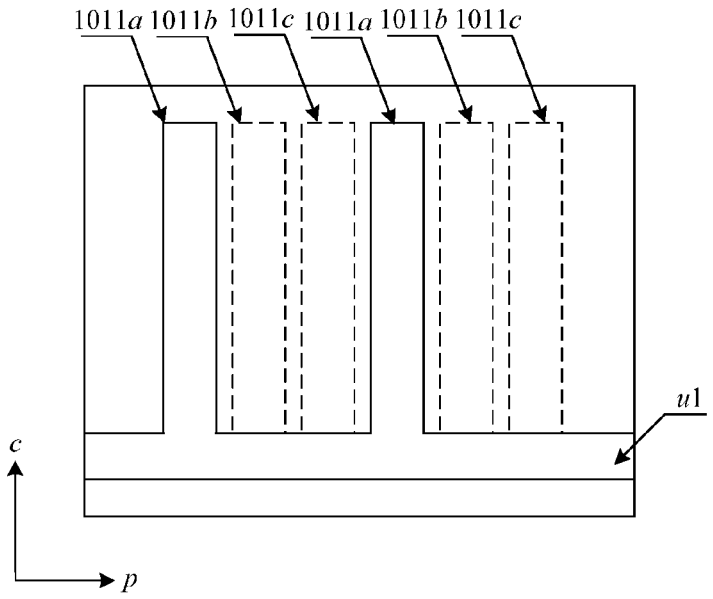
FIG. 4 is a top view of the printing head as shown in FIG. 3.

FIG. 2 is a schematic structure diagram of a printing head according to an exemplary embodiment of the present invention, in which the flowing direction of ink is indicated by a dotted arrow. FIG. 3 is a schematic diagram of projections, in a diversion trench plane, of diversion trenches of the printing head as shown in FIG. 2. FIG. 4 is a top view of the printing head as shown in FIG. 3.

Referring to FIG. 2 to FIG. 4, the printing head according to an exemplary embodiment of the present invention may include a plurality of sub-heads 100 (three sub-heads 100 are shown in FIG. 2). Each of the sub-heads 100 includes a base 101 and a plurality of diversion trenches 1011 provided in the base 101, and one end of each of the diversion trenches 1011 is connected to one of nozzles 1012 of the sub-head 100. The base 101 may be made of silicon-based material.

Projections of all the diversion trenches 1011 of the sub-heads 100 on the diversion trench plane $\alpha$ (i.e., a first plane) in a first projection direction t are arranged at an equal interval (referring to FIG. 4). Referring to FIG. 3, the diversion trench plane $\alpha$ is a plane defined by an arrangement direction p and a length direction c of the diversion trenches 1011 in the sub-head 100. The first projection direction t is a moving direction (also called printing direction) of the printing head with respect to a printing surface during printing. The spacing between adjacent diversion trenches 1011 in each of the sub-heads 100 is greater than the spacing between the projections of all the diversion trenches on the diversion trench plane $\alpha$ in the first projection direction t.

It is to be noted that, as for the piezoelectric head, a protection film and piezoelectric material (such as piezoelectric ceramics) may cover the diversion trenches of each of the sub-heads. The protection film and the piezoelectric material may be adhered to the base 101 by an adhesive, and cover the diversion trenches. However, the concept of the present invention may be applied to printing heads of other types (such as a bubble head), and hence, the protection film and the piezoelectric material of the piezoelectric head are not shown in the drawings.

As shown in FIG. 3, the projections 1011*a*, 1011*b* and 1011*c* of three sub-heads 100*a*, 100*b* and 100*c* on the diversion trench plane α are arranged in the diversion trench plane α at an equal interval. It is to be noted that the diversion trench plane α is merely a theoretical plane, i.e., a plane defined by the arrangement direction p and the length direction c of the diversion trenches. Although the diversion trench plane α is shown in FIG. 3 as the top surface of the sub-head 100*a*, the diversion trench plane α may be any plane parallel to the top surface of the sub-head 100*a*.

As shown in FIG. 3, the diversion trenches corresponding to any two adjacent projections belong to different sub-heads. Therefore, for a same pixel pitch, the spacing between adjacent diversion trenches of the sub-head in the printing head according to the embodiments of the present invention is greater than the spacing between adjacent diversion trenches of one head in which all the nozzles are formed in the prior art, so that the difficulty in manufacturing the sub-heads is reduced. Furthermore, as the thickness of a spacer (not shown in FIG. 3), used for fixing the piezoelectric material, between two adjacent diversion trenches in the sub-head is increased, the contact area between the piezoelectric material (or the protection film below the piezoelectric material) and the spacer is thus increased, and consequently, the connection reliability of the piezoelectric material is improved. Additionally, each of the sub-heads may further include an ink tank communicated with all the diversion trenches of the sub-head. In FIG. 3, an ink tank u1 is arranged in the sub-head 100*a*, an ink tank u2 is arranged in the sub-head 100*b*, and an ink tank u3 is arranged in the sub-head 100*c*. Both ends of each of the ink tanks u1, u2 and u3 are respectively an ink inlet and an ink outlet.

Figure 5:
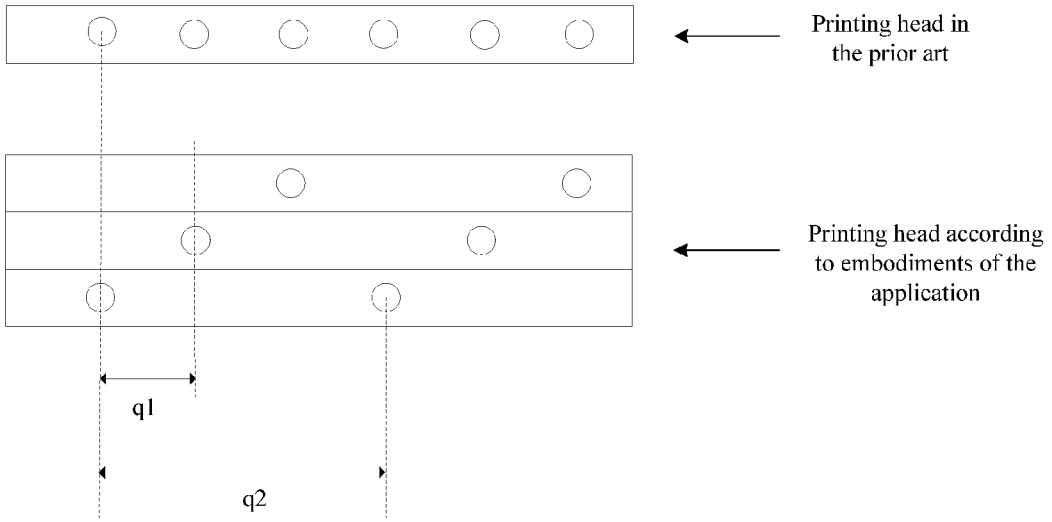
FIG. 5 is a schematic comparison diagram of the printing head in the prior art and the printing head according to the exemplary embodiment of the present invention.

FIG. 5 is a schematic comparison diagram of the printing head in the prior art and the printing head according to the exemplary embodiments of the present invention. As shown in FIG. 5, in the case of the same pixel pitch, the spacing q1 between adjacent nozzles of the printing head in the prior art is smaller than the spacing q2 between adjacent nozzles of the sub-head in the printing head according to the exemplary embodiments of the present invention. Hence, in the printing head according to the embodiments of the present invention, the interference between the adjacent nozzles may be reduced.

In conclusion, in the printing head according to the embodiments of the present invention, the nozzles are arranged on a plurality of sub-heads, so that, in the case of the same pixel pitch, the number of the nozzles in each of the sub-heads is relatively small (that is, the density of the nozzles in each of the sub-heads is reduced). The spacing of the diversion trenches corresponding to the respective nozzles is thus relatively large. As a result, the interference among the nozzles caused by the same piezoelectric material is reduced, and the quality of printing is thus improved. It is to be noted that, although the density of the nozzles in each of the sub-heads is reduced, the density of the nozzles of the entire printing head is not reduced, thereby meeting demands on the printing resolution.

Figure 6:
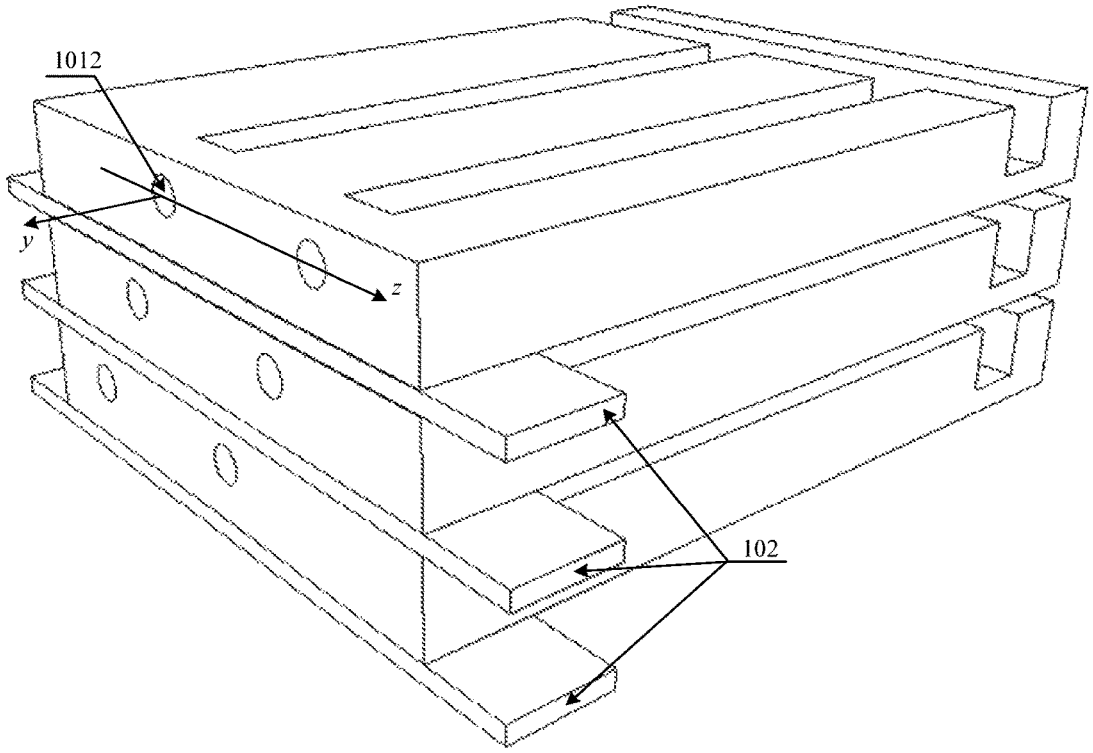
FIG. 6 is a schematic structure diagram of a printing head according to another exemplary embodiment of the present invention.

FIG. 6 is a schematic structure diagram of a printing head according to another exemplary embodiment of the present invention.

As shown in FIG. 6, compared with the printing head according to the aforementioned embodiments, a sliding mechanism 102 is provided on each of the sub-heads and used for adjusting relative positions of the sub-heads. For example, the sliding mechanism 102 may be a sliding rail, and each of the sub-heads may slide on a corresponding sliding rail to adjust the relative positions of the sub-heads. Additionally, the sliding mechanism 102 may further be a strip-like plate provided with a plurality of through holes in the arrangement direction z of the nozzles 1012, and the sub-heads may be fixed at different positions on the strip-like plate by screws passing through the through holes so as to adjust the relative positions of the plurality of sub-heads. It is to be noted that the nozzles 1012 generally are tubular, the liquid outlet direction y of the nozzle 1012 may be consistent with an axis direction of the nozzle 1012, and the arrangement direction z of the nozzles 1012 may be the arrangement direction of axes of the nozzles 1012. It is to be noted that the sliding mechanism 102 may also be other mechanism which enables the sub-heads to slide, such as a conveyor, a roller, a stepper motor or the like, and the present invention is not limited thereto.

Figure 7:
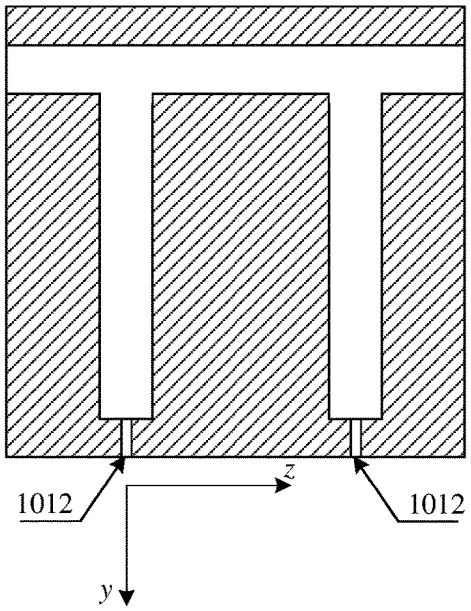
FIG. 7 is a sectional view of sub-heads in the printing head as shown in FIG. 6.

FIG. 7 is a sectional view of sub-heads in the printing head as shown in FIG. 6.

A nozzle plane (i.e., the second plane) is a plane defined by the arrangement direction z of the nozzles 1012 and the liquid outlet direction y of the nozzles 1012. As shown in FIG. 7, when the liquid outlet direction y of the nozzles 1012 is consistent with the length direction c of the diversion trenches, the nozzle plane is parallel to the diversion trench plane.

Figure 8:
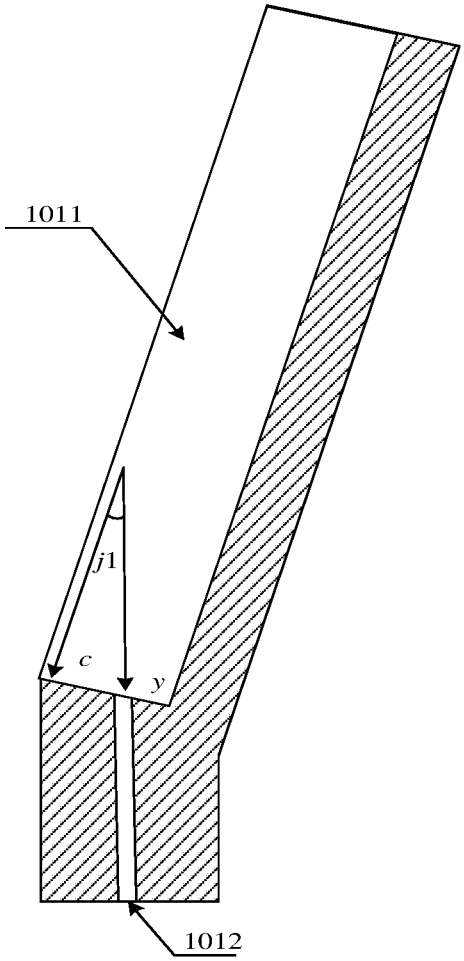
FIG. 8 is a sectional view of sub-heads in the printing head according to another exemplary embodiment of the present invention.

It is to be noted that there may be a certain angle between the liquid outlet direction y of the nozzles and the length direction c of the diversion trenches. FIG. 8 is a sectional view of sub-heads in the printing head according to another exemplary embodiment of the present invention. As shown in FIG. 8, there is an included angle j1 between the liquid outlet direction y of the nozzles 1012 and the length direction c of the diversion trenches 1011, and in this case, there is also an included angle j1 between the nozzle plane and the diversion trench plane.

Figure 9:
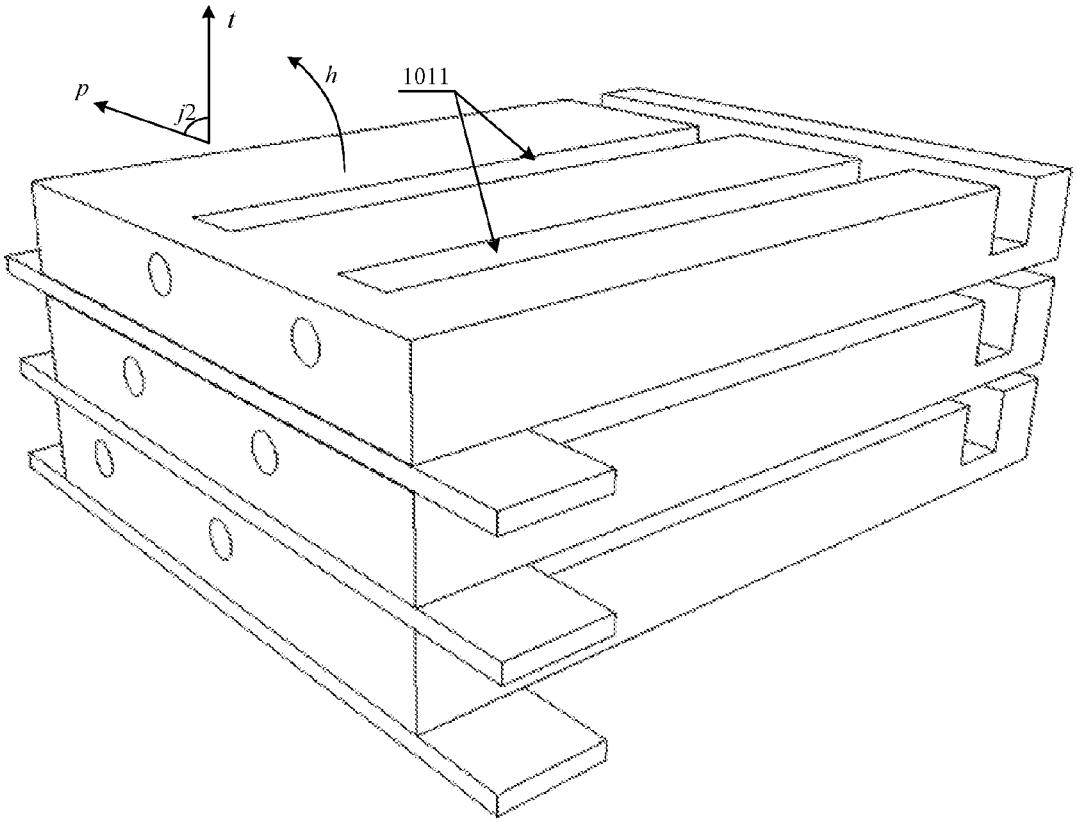
FIG. 9 is a schematic structure diagram of a printing head according to another exemplary embodiment of the present invention.
Figure 10:
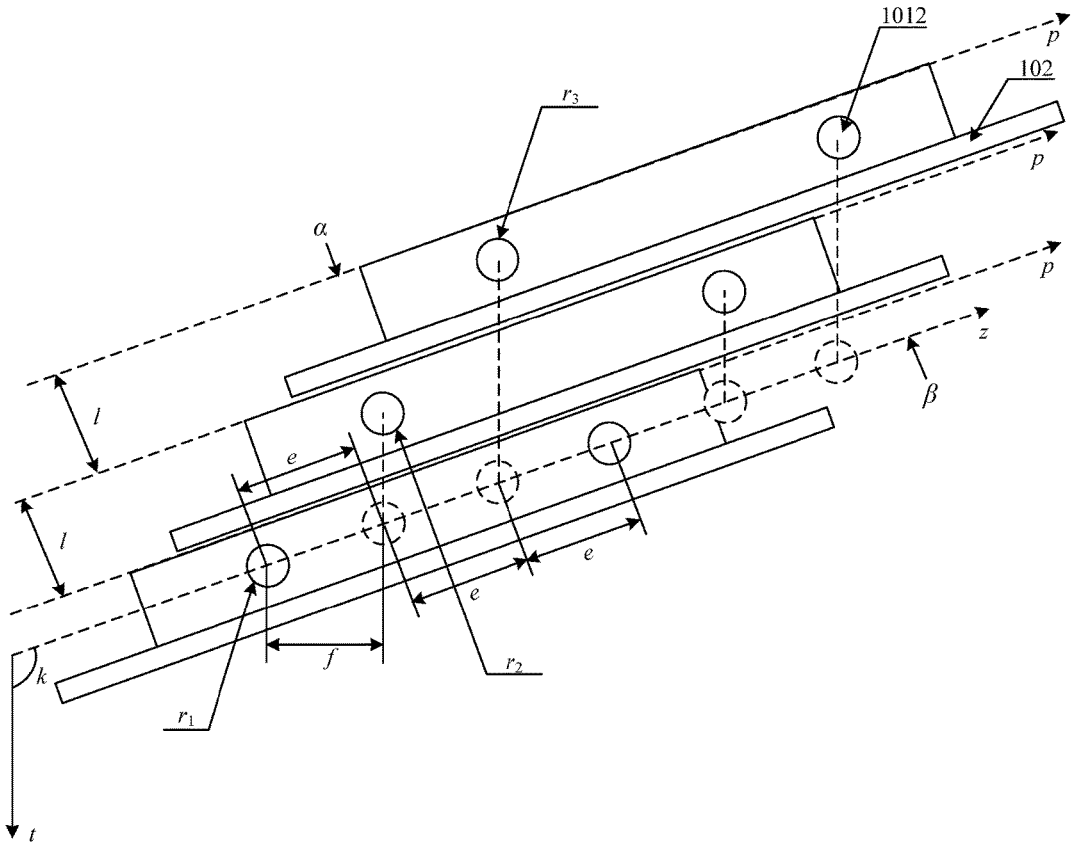
FIG. 10 is a front view of the printing head as shown in FIG. 9.

FIG. 9 is a schematic structure diagram of a printing head according to another exemplary embodiment of the present invention, and FIG. 10 is a front view of the printing head as shown in FIG. 9.

The printing head according to the exemplary embodiment of the present invention may further include an angle adjusting mechanism (not shown in FIG. 9) used for adjusting an included angle j2 between the arrangement direction p (the arrangement direction z of the nozzles 1012) of the diversion trenches 1011 of the sub-heads and the first projection direction t. For example, the angle adjusting mechanism may be a disk, and all the sub-heads are fixed onto the disk. When the disk rotates around a central axis thereof (the rotation direction h is as shown in FIG. 9), the arrangement direction p of the diversion trenches 1011 of the sub-heads may be adjusted, thereby changing the included angle j2 between the arrangement direction p of the diversion trenches and the first projection direction t.

Referring to FIG. 10, the arrangement directions of the diversion trenches of the respective sub-heads are parallel to each other, and the distance 1 between top surfaces of any two adjacent sub-heads is the same, each of the sub-heads has the same number of nozzles 1012, and the nozzle plane β is parallel to the diversion trench plane α (that is, the liquid outlet direction y of the nozzles is parallel to the length direction c of the diversion trenches). The sliding mechanism 102 may adjust the spacing e of projections of the nozzles 1012 of the plurality of sub-heads on the nozzle plane β in the first projection direction t, and the angle adjusting mechanism may cooperate with the sliding mechanism 102 so that the spacing e of the projections and the pixel pitch f meet the rotation angle formula: $\cos(k-90)=f/e$, where k is an included angle, greater than or equal to 90°, between the nozzle plane β and the first projection direction t.

Additionally, projections of starting nozzles of the respective sub-heads on the nozzle plane β in the first projection direction t are arranged at an equal interval, and here, the starting nozzle is the first one of the nozzles of each of the sub-heads in a same direction. For example, the nozzles r1, r2 and r3 are respectively starting nozzles of three sub-heads as shown in FIG. 10, and the spacing among the projections of the three starting nozzles r1, r2 and r3 in the nozzle plane β in the first projection direction t is e.

Figure 11:
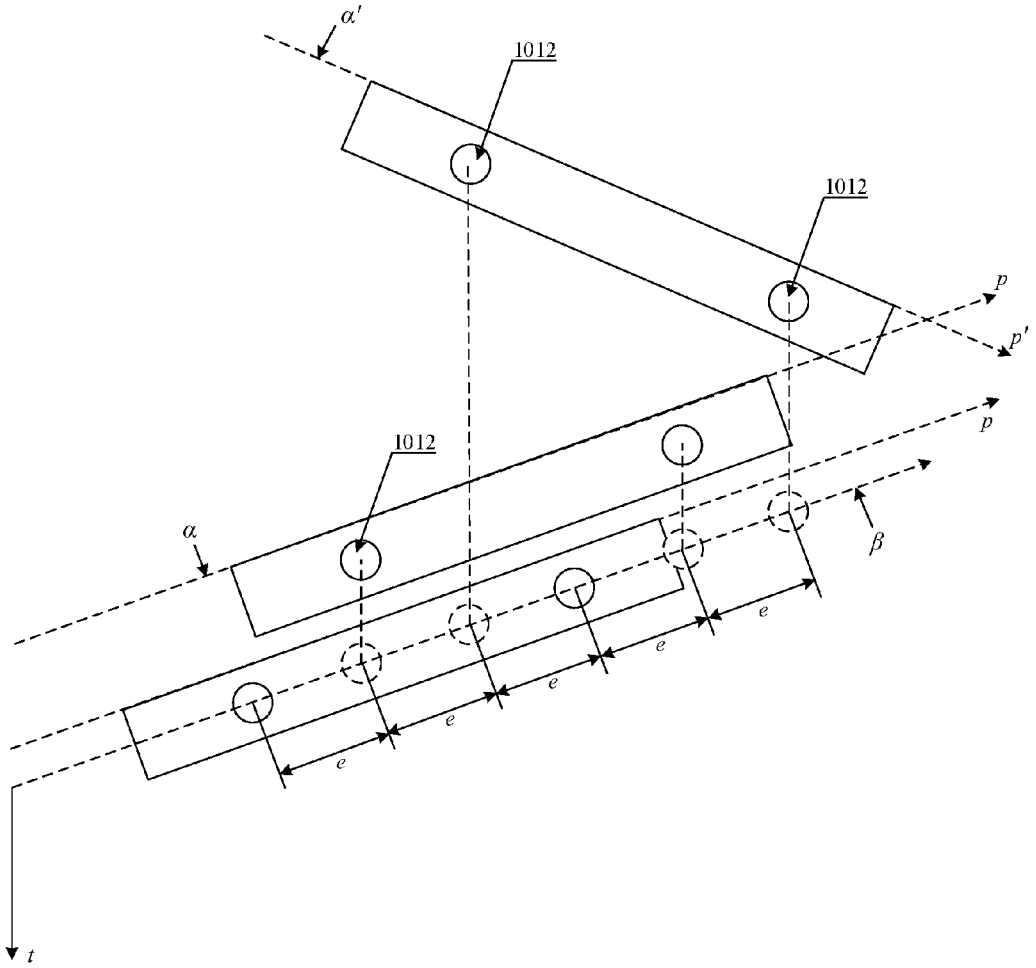
FIG. 11 is a front view of the printing head according to another exemplary embodiment of the present invention.

It needs to be noted that the arrangement directions p of the diversion trenches of the respective sub-heads may not be parallel to each other. FIG. 11 is a front view of a printing head according to another exemplary embodiment of the present invention.

As shown in FIG. 11, the arrangement direction p' of the diversion trenches of one of the sub-heads intersects with the arrangement direction p of the diversion trenches of the other two sub-heads. However, as long as the projections of the nozzles 1012 of the respective sub-heads on the nozzle plane β in the first projection direction t are arranged at an equal interval, the printing head according to the present invention can be realized. The nozzle plane β is parallel to the diversion trench plane α defined by the arrangement direction p and the length direction c of the diversion trenches. As long as the projections of the nozzles 1012 on the nozzle plane β in the first projection direction t are arranged at an equal interval, the projections of diversion trenches corresponding to the respective nozzles 1012 on the diversion trench plane α in the first projection direction t are also arranged at an equal interval.

Figure 12:
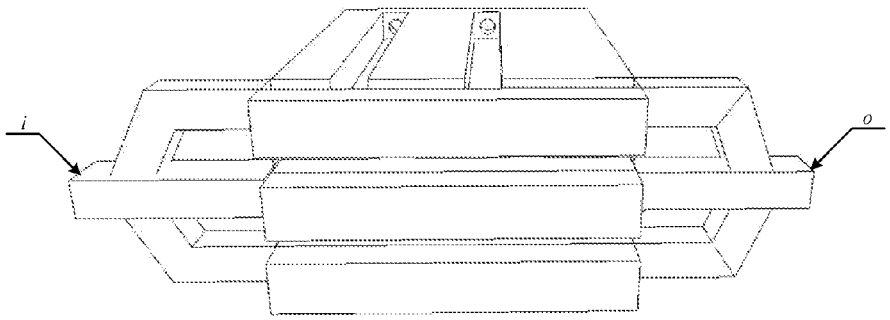
FIG. 12 is a schematic structure diagram of the printing head according to another exemplary embodiment of the present invention.

FIG. 12 is a schematic structure diagram of a printing head according to another exemplary embodiment of the present invention.

As shown in FIG. 12, the printing head may further include a common ink inlet i and a common ink outlet o. One end of each of the ink tanks is communicated with the common ink inlet i, and the other end thereof is communicated with the common ink outlet o.

Figure 13:
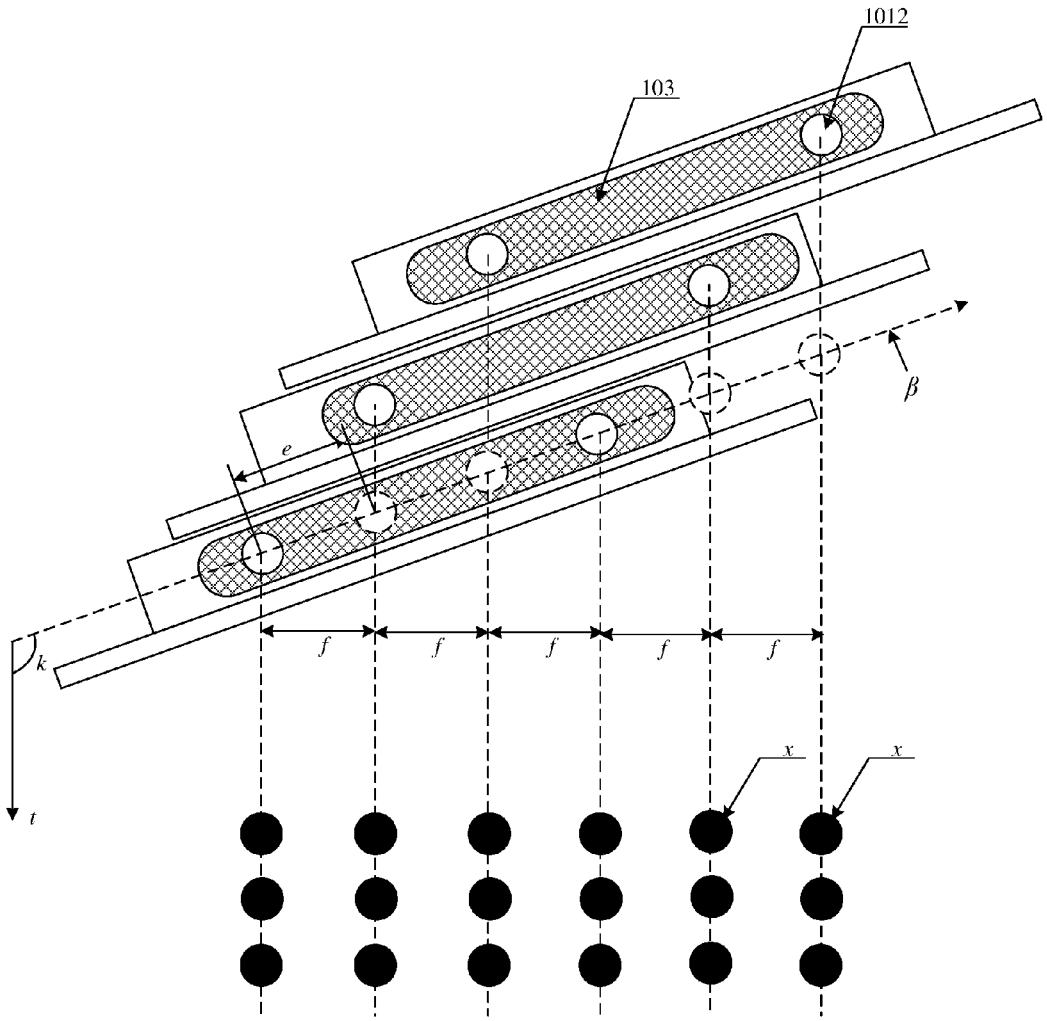
FIG. 13 and FIG. 14 are schematic diagrams illustrating printing of the printing head as shown in FIG. 9.
Figure 14:
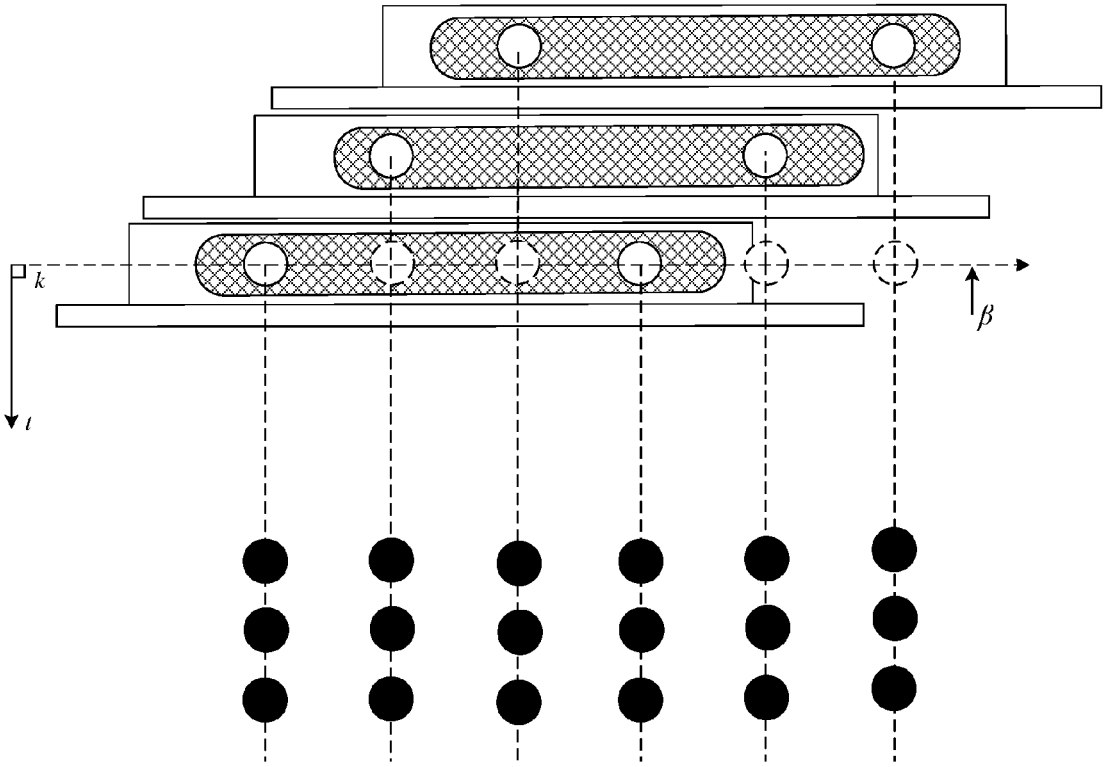

FIG. 13 and FIG. 14 are schematic diagrams illustrating the printing of the printing head as shown in FIG. 9.

As shown in FIG. 13, a liquid outlet surface of each of the nozzles (a plane of an opening of each of the nozzles) is parallel to the printing surface (that is, the liquid outlet direction y of the nozzles is vertical to the printing surface), and pixel points are located on the printing surface. To facilitate viewing and understanding, the liquid outlet surfaces of the nozzles for printing pixel points shown in FIG. 13 are in the same plane. The distance f between adjacent pixel points x and the spacing e of the projections of the nozzles 1012 of the plurality of sub-heads on the nozzle plane β in the first projection direction t meet the following rotation angle formula: $\cos(k-90)=f/e$, where k is an included angle, greater than or equal to 90°, between the nozzle plane β and the first projection direction t. Thus, it can be seen that the printing head according to the embodiments of the present invention may allow the distance f between adjacent pixel points x to be smaller than the spacing of the nozzles 1012 in the sub-head. The spacing of the nozzles 1012 in the sub-head shown in FIG. 3 is 3e, f is smaller than e, and f is thus smaller than 3e. Hence, the distance f between adjacent pixel points x is smaller than the spacing of the nozzles 1012 in the sub-head, which is particularly advantageous for printing with high resolution and small pixel pitch f.

According to the embodiments of the present invention, a lyophobic functional film 103 may cover a peripheral region of the nozzle 1012. The liquid (for example, ink droplets) is not liable to be adhered to the lyophobic functional film 103, and it is thus convenient to clean the peripheral region of the nozzle 1012.

As shown in FIG. 14, an included angle k between the nozzle plane β and the first projection direction t is equal to 90°. The spacing of the nozzles 1012 in the sub-head is 3e, f is equal to e, and f is thus smaller than 3e. Hence, the distance f between adjacent pixel points x is smaller than the spacing of the nozzles 1012 in the sub-head.

During printing, image data needs to be transformed into data for each of the nozzles. This transformation is called raster image process (RIP). Generally, the image data is positioned by two coordinates of x and y. Therefore, the data applied to each of the nozzles is coordinate data.

Figure 15:
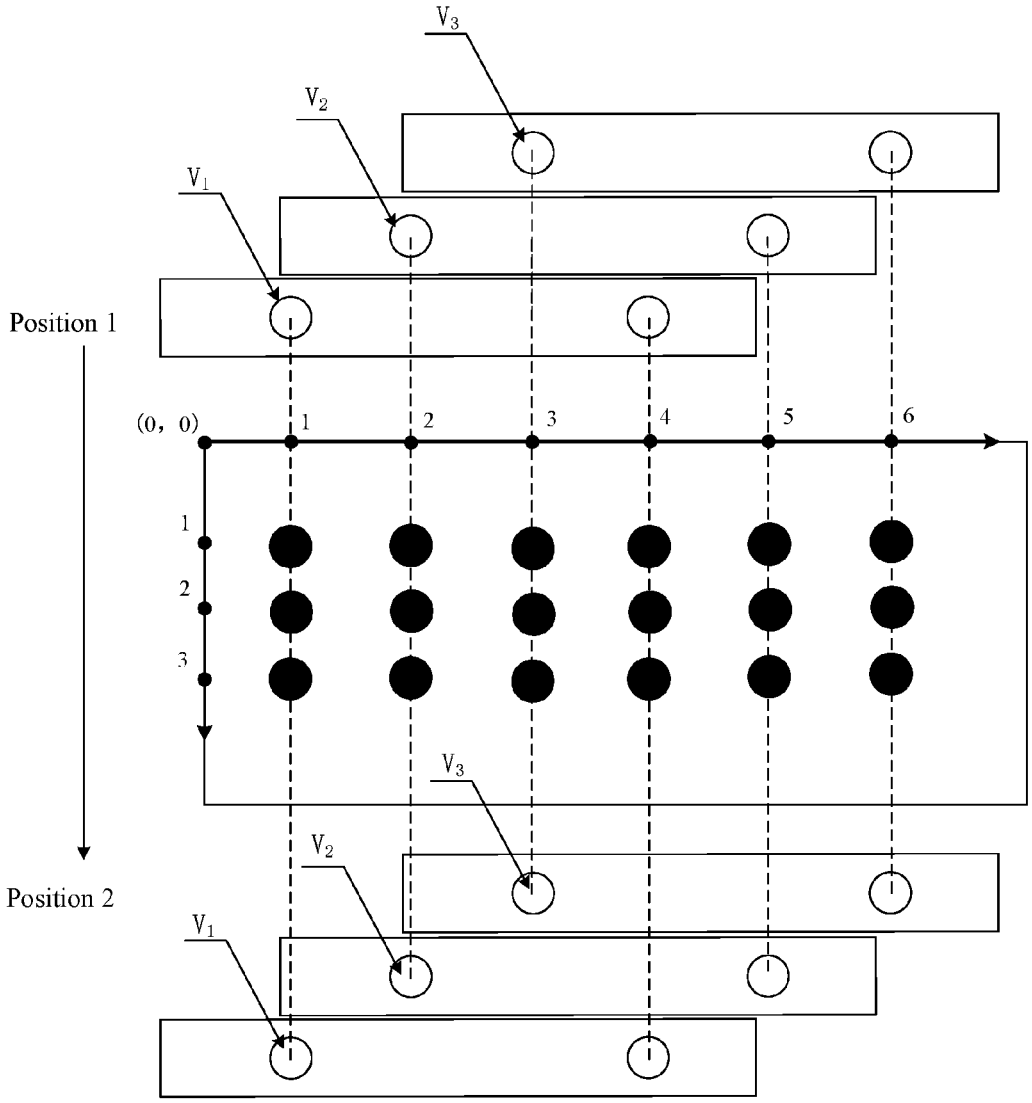
FIG. 15 is a schematic diagram illustrating a printing process of the printing head according to the exemplary embodiments of the present invention.

FIG. 15 is a schematic diagram of a printing process of the printing head according to the exemplary embodiments of the present invention.

As shown in FIG. 15, taking a printing head consisting of three sub-heads as an example, the first nozzles of the sub-heads from bottom to top are respectively V1, V2 and V3. The printing surface is indicated by a dotted box, and a rectangular coordinate system is established by taking the top left corner of the printing surface as the origin (0, 0). The printing head proceeds from position 1 to position 2. The nozzle V1 jets ink at positions of coordinates (1, 1), (1, 2) and (1, 3), the nozzle V2 jets ink at positions of coordinates (2, 1), (2, 2) and (2, 3), the nozzle V3 jets ink at positions of coordinates (3, 1), (3, 2) and (3, 3), and so on for positions at which other nozzles jet ink. In this way, a rectangular matrix consisting of ink dots as shown in FIG. 15 can be printed.

Compared with the printing head in the prior art, in the printing head according to the embodiments of the present invention, the spacing of the diversion trenches in the sub-head is increased, and furthermore, the spacing of the nozzles in the sub-head is increased and the manufacturing difficulty is reduced. As the thickness of the spacer arranged between two adjacent diversion trenches in the sub-head and used for fixing the piezoelectric material is increased, the contact area between the piezoelectric material (or the protection film below the piezoelectric material) and the spacer is increased, and consequently, the connection reliability of the piezoelectric material is improved.

Each of the sub-heads of the printing head according to the embodiments of the present invention has the same number of nozzles, and hence, the sub-heads can be manufactured according to the same specification. This is beneficial for mass production and the manufacturing cost is reduced.

In the printing head according to the embodiments of the present invention, by providing the sliding mechanism and the angle adjusting mechanism, the spacing of the projections of the nozzles on the respective sub-heads in the nozzle plane can be adjusted to meet different demands on the pixel pitch. This is particularly advantageous for printing with high resolution.

In the printing head according to the embodiments of the present invention, by providing an ink tank for each of the sub-heads, the interference generated when different sub-heads share one ink tank is avoided.

Additionally, in the printing head according to the embodiments of the present invention, the nozzles are arranged in a plurality of sub-heads, so that, in the case of the same pixel pitch, the number of the nozzles in each of the sub-heads is relatively small, and the spacing of the diversion trenches corresponding to the respective nozzles is thus relatively large. As a result, the interference among the nozzles caused by the same piezoelectric material is reduced, and the quality of printing is thus improved.

The printing head according to the embodiments of the present invention, for example, the printing head in the embodiment as shown in FIG. 2, the printing head in the embodiment as shown in FIG. 6, the printing head in the embodiment as shown in FIG. 9, the printing head in the embodiment as shown in FIG. 11 or the printing head in the embodiment as shown in FIG. 12, may be applied to various ink-jet printing devices.

Although the concept of the present invention has been described with reference to the embodiments of the present invention, the present invention is not limited to the embodiments set forth herein. Any modifications, equivalent substitutions, improvements and the like of the described embodiments of the present invention should be within the protection scope of the present invention.

The invention claimed is:

1. A printing head, comprising a plurality of sub-heads each comprising a base and a plurality of diversion trenches provided on the base, wherein one end of each of the diversion trenches is connected to one of nozzles of the sub-head, projections of all the diversion trenches on a first plane in a first projection direction are arranged at an equal interval, the first plane is a plane defined by an arrangement direction and a length direction of the diversion trenches in the sub-head, and the first projection direction is a moving direction of the printing head with respect to a printing surface during printing, and a spacing of the diversion trenches in each of the sub-heads is greater than that of projections of all the diversion trenches on the first plane in the first projection direction, wherein each of the sub-heads further comprises a sliding mechanism for adjusting relative positions of the plurality of sub-heads in the arrangement direction of the diversion trenches.

2. The printing head according to claim 1, wherein, the diversion trenches corresponding to any two adjacent projections on the first plane belong to different sub-heads.

3. The printing head according to claim 1, wherein, each of the sub-heads further comprises an ink tank arranged on the base and communicated with each of the diversion trenches.

4. The printing head according to claim 3, further comprising a common ink inlet and a common ink outlet, wherein one end of the ink tank of each of the sub-heads is connected to the common ink inlet and the other end thereof is connected to the common ink outlet.

5. The printing head according to claim 1, wherein, the arrangement directions of all the diversion trenches are parallel to each other.

6. The printing head according to claim 1, wherein, projections of starting nozzles of the respective sub-heads on a second plane in the first projection direction are arranged at an equal interval, the starting nozzle is the first one of the nozzles of each of the sub-heads in a same direction, and the second plane is a plane defined by an arrangement direction and a liquid outlet direction of the nozzles of the sub-head.

7. The printing head according to claim 1, further comprising an angle adjusting mechanism for adjusting an included angle between the arrangement direction of the diversion trenches of the sub-head and the first projection direction to meet the following formula:

where k is an included angle, greater than or equal to 90°, between a second plane and the first projection direction, the second plane is a plane defined by an arrangement direction and a liquid outlet direction of the nozzles of the sub-head, e is a spacing of projections of all the nozzles on the second plane in the first projection direction, and f is a pixel pitch.

8. The printing head according to claim 1, wherein, a distance between top surfaces of any two adjacent sub-heads is the same.

9. The printing head according to claim 1, wherein, each of the sub-heads has the same number of nozzles.

10. An ink-jet printing device, comprising the printing head according to claim 1.

11. The ink-jet printing device according to claim 10, wherein, the diversion trenches corresponding to any two adjacent projections on the first plane belong to different sub-heads.

12. The ink-jet printing device according to claim 10, wherein, each of the sub-heads further comprises an ink tank arranged on the base and communicated with each of the diversion trenches.

13. The ink-jet printing device according to claim 12, the printing head further comprising a common ink inlet and a common ink outlet, wherein one end of the ink tank of each of the sub-heads is connected to the common ink inlet and the other end thereof is connected to the common ink outlet.

14. The ink-jet printing device according to claim 10, wherein, the arrangement directions of all the diversion trenches are parallel to each other.

15. The ink-jet printing device according to claim 10, wherein, projections of starting nozzles of the respective sub-heads on a second plane in the first projection direction are arranged at an equal interval, the starting nozzle is the first one of the nozzles of each of the sub-heads in a same direction, and the second plane is a plane defined by an arrangement direction and a liquid outlet direction of the nozzles of the sub-head.

16. The ink-jet printing device according to claim 10, the printing head further comprising an angle adjusting mechanism for adjusting an included angle between the arrangement direction of the diversion trenches of the sub-head and the first projection direction to meet the following formula:

where k is an included angle, greater than or equal to 90°, between a second plane and the first projection direction, the second plane is a plane defined by an arrangement direction and a liquid outlet direction of the nozzles of the sub-head, e is a spacing of projections of all the nozzles on the second plane in the first projection direction, and f is a pixel pitch.

17. The ink-jet printing device according to claim 10, wherein, a distance between top surfaces of any two adjacent sub-heads is the same.

18. The ink-jet printing device according to claim 10, wherein, each of the sub-heads has the same number of nozzles.

* * * * *